US011172733B1

(12) United States Patent
Baker

(10) Patent No.: US 11,172,733 B1
(45) Date of Patent: Nov. 16, 2021

(54) SHOE

(71) Applicant: Scott Bradley Baker, Sherman Oaks, CA (US)

(72) Inventor: Scott Bradley Baker, Sherman Oaks, CA (US)

( * ) Notice: Subject to any disclaimer, the term of this patent is extended or adjusted under 35 U.S.C. 154(b) by 308 days.

(21) Appl. No.: 16/192,530

(22) Filed: Nov. 15, 2018

Related U.S. Application Data

(63) Continuation of application No. 14/297,905, filed on Jun. 6, 2014, now Pat. No. 10,178,893.

(60) Provisional application No. 61/835,445, filed on Jun. 14, 2013.

(51) Int. Cl.

| | |
|---|---|
| ***A43B 23/02*** | (2006.01) |
| ***A43B 3/02*** | (2006.01) |
| ***A43C 11/12*** | (2006.01) |
| ***A43B 5/00*** | (2006.01) |
| ***A43B 3/24*** | (2006.01) |

(52) U.S. Cl.
CPC ..... *A43B 23/0245* (2013.01); *A43B 3/02* (2013.01); *A43B 3/242* (2013.01); *A43C 11/12* (2013.01); *A43B 5/00* (2013.01)

(58) Field of Classification Search
CPC ..... A43B 23/0245; A43B 3/242
USPC ..... 36/109
See application file for complete search history.

(56) References Cited

FOREIGN PATENT DOCUMENTS

IT P120104000030 12/2010

*Primary Examiner* — Alissa J Tompkins
*Assistant Examiner* — Catherine M Ferreira

(57) ABSTRACT

A shoe comprises a sole having an upper surface and a lower surface, and a top member having an outer surface and an inner surface and mounted on the sole. The top member and sole to together define a space for receiving a foot, and the top member further comprises an opening. A fastener is provided in the top member and extends from the opening and continues over the top member such that a portion of the top member is movable between a first position in which the space is substantially closed and a second position in which a portion of the top member is folded back from the sole to provide access to the space.

17 Claims, 8 Drawing Sheets

SHOE

CROSS REFERENCE TO RELATED APPLICATIONS

This application is a continuation of U.S. patent application Ser. No. 14/297,905 filed Jun. 6, 2014, which claims the benefit of U.S. Provisional Patent Application No. 61/835,445 filed on Jun. 14, 2013, the contents of which are Incorporated by reference herein in their entirety.

FIELD AND BACKGROUND OF THE INVENTION

This invention relates to a shoe. More particularly, the invention relates to a shoe which is configured and constructed so that it may be placed on the foot of the wearer in a more convenient manner. While the shoe of the invention may be used in many applications, and certainly has a mainstream use for all or most people, its particular construction may be of special benefit to handicapped or disabled people. In this regard, the shoe of the invention offers a simpler and more natural way to place the foot within the shoe, and may be advantageous for people who have a reduced response to touch on the foot, or a loss of muscular control in the foot, are paralyzed at the foot, or have other medical issues with their feet.

A shoe is of course a common item worn by most people and comes in a plethora of different shapes, forms and sizes. Further, different types of shoe have been manufactured for different purposes. The shoes may be generally closed, partly closed, or substantially open. They may be specially developed for sporting activities, casual wear, dress wear, dancing, to name just a few examples. Additionally, a shoe may be constructed as a heavy duty protective item for the foot, typically used in rugged outdoor activities, or in a military or law enforcement environment.

A conventional closed or partially closed shoe comprises a base or sole and a top stitched or otherwise fastened to the sole. The top will typically have a chamber or housing area for the foot, and an opening through which the foot accesses the chamber. In many shoes, the opening may be of adjustable size so that it can be larger when inserting the foot, and reduced in size when the foot is inside the shoe. The opening is adjusted by the user by means of shoelaces, Velcro straps or elasticized portions around the opening, to name some examples.

The opening in the top of a conventional shoe is positioned such that the foot must be inserted into the chamber or housing area for the foot through the opening toe first, followed by the remainder of the foot. In many cases, this will work well and the average person is able to position and wiggle the toes and foot so that it is properly contained within the generally snug fitting chamber or housing. However, the wearer must have the capacity and ability to flex and move the foot and toes to put on the shoe. This may be a particular challenge for a person who may have muscular weakness of the foot or legs or is in fact paralyzed. The effect of a paralysis is that a person will not, of course, have any feeling in the foot or toes, which makes the putting on of a shoe much more of a challenge. Children may also find it difficult to put on a closed or partially closed shoe of conventional structure. While most people take for granted the ability to use the foot as necessary to put on a shoe, there are many who lack this ability due to foot paralysis or some other medical condition, or young age, and conventional shoes with the type of opening as described above will therefore be difficult to put on. It is conceivable that a person with a paralyzed foot may be able to squeeze the foot into the shoe, but if the toes were cramped or bent as a result, the user may not even know this but would nevertheless have to deal with possible consequences including reduced circulation and swelling.

Therefore, individuals with disabilities that inhibit all or most of the movement and muscular control of their lower extremities often suffer circulatory problems caused by wearing shoes. The problem tends to occur when a person puts his foot into a shoe of any type without the muscular ability or strength to hold his toes out straight and then slide his foot into the chamber of the shoe. Without this muscular control, the toes may bend and curl and bind thus causing circulation to the foot or other parts to be limited causing swelling, potential pain, and a deterioration of extremity health. The longer the foot is in this position the worse the condition becomes. This invention allows for the entire front and top of the shoe to open up and out of the way thus allowing the wearer to slide the front of the shoe across the bottom of the foot starting at the wearer's heel and moving towards the toes. By moving the shoe in this direction, it automatically maintains the toes in the correct and flat and natural position, which is essential for proper circulation and continued health of the foot.

SUMMARY OF THE INVENTION

According to one aspect of the invention, there is provided a shoe comprising: a sole having an upper surface and a lower surface; a top member having an outer surface and an inner surface and mounted on the sole, the top member and sole defining a space for receiving a foot, the top member further having an opening; and a fastener in the top member extending from the opening and continuing over the top member such that a portion of the top member is movable between a first position in which the space is substantially closed and a second position in which a portion of the top member is folded back from the sole to provide access to the space.

In one embodiment, the opening in the top member is located at one end of the shoe and sized so as to permit the leg or ankle of the wearer to extend therethrough. The fastener may comprise a zipper, a Velcro fastener, a combination thereof, or some other structure such as a snap.

Preferably, the fastener commences in the top member at the opening thereof, extends from the opening in a downward taper towards the sole, and continues around the top member near the junction of the top member and sole and continues in the top member along the inner side of the shoe to and around the front end thereof and partially along the outer side of the shoe.

In one embodiment, the shoe has a heel end, a generally opposite front end, an inner side and an outer side, the opening being located near the heel end, the fastener commencing in the top member at the opening thereof, extends from the opening downwardly toward the sole, and continues in the top member along the inner side of the shoe to and around the front end thereof and partially along the outer side of the shoe. The outer side of the shoe is, therefore, on the opposite side of the shoe than that which the fastener traveled down.

The shoe may comprise a boot and the top portion includes a foot component and an upwardly extending tubular component with the opening at a free end thereof, the fastening means extending from the opening down the tubular component and over the foot component of the top portion. In another form, the shoe may comprise a sneaker style shoe including laces and a tongue on the top portion, or a high heel style shoe with an enlarged opening.

In the latter case, the fastening means may be a zipper, the zipper may be concealed or hidden by a decorative strip, and the zipper includes a zipper tab which may have a decorative configuration.

In yet another form, the shoe comprises a biker style short boot, the top portion comprises a foot component and an upwardly extending tubular component with the opening at the free end thereof, and the fastener comprises a Velcro fastener extending from the opening to a lower point near the sole and a zipper extending from the lower point near the sole around the top portion. The zipper continues in the top member along the inner side of the shoe to and around the front end thereof and partially along the outer side of the shoe.

The shoes may have laces which are of a decorative nature, or the laces may be adjustable to vary the size of the space according to the nature of the foot that will be accommodated therein.

According to a further aspect of the invention, there is provided a method of making a shoe comprising the following steps: forming a sole or base having an upper surface and a lower surface; mounting a top portion having an opening over the upper surface of the sole such that the sole and top portion define a space for accommodating a foot; and inserting a fastener in the top portion extending from the opening and continuing around the top portion and around the front end thereof and partially along the outer/opposite side of the shoe, so that at least a part of the top portion can be selectively moved between a first closed position in which the fastener is closed and a second open position to provide access to the space from the front of the shoe.

In yet a further aspect of the invention, there is provided a method of putting on a shoe having a sole, a top portion mounted on the sole so as to define a space, and a fastener in the top portion so that a part thereof can be folded between an open and closed position, the method comprising: moving the part of the top portion into the open position to provide access to the space from the front of the shoe; placing the foot on the sole and positioning the foot thereon; and moving the part of the top portion into the closed position to capture the foot in the space defined between the sole and the top portion. Preferably, the heel is placed on the sole at or near the front end of the shoe, and the shoe and/or foot are moved relative to each other so that the foot slides over the sole until it reaches the back of the shoe.

This invention therefore relates to a shoe with a unique structure and configuration which enables it to be placed on the foot and removed therefrom in a more convenient and natural movement.

The invention provides for a shoe having a base or sole, a top mounted on the sole so that sole and top together define a space for receiving a foot, an opening on the top, and fastening means whereby at least a part of the top may be selectively separated from the sole to allow the foot to be inserted into or removed from the shoe, and fastened to the sole when the foot is in the space defined by the shoe so as to keep the foot securely within the space.

For the most part, when a person puts on shoes, he or she without even giving it much conscious thought is holding their toes out straight and sliding the foot into the shoe. Without muscular control, the toes are likely to bend under, fold and bind. When the toes are in a folded position, the entire skeletal structure of the foot must make adjustments. An inherent problem in this regard is the restricted circulation of blood that may occur, and with this restriction comes the swelling of tissue. These conditions may have a domino or compounding effect, in that the more the foot swells, the more restriction is likely, in turn producing yet more swelling. This of course leads to the diminished health of the foot, and the various tissues and components which form it.

When placing the heel of the foot at the front of an open shoe constructed in accordance with the present invention and sliding the shoe forward and/or the foot backward, this action directs the toes to lay out in a flat and normal position, thus maintaining unimpaired circulation and not resulting in any swelling, both of which can occur in conventional shoes with conventional entry procedures. In accordance with one embodiment of the invention, the top of the shoe is connected to the base or sole by means of a zipper extending from the opening toward the base and partly around the shoe. In one embodiment, the zipper when closed is designed to be on the inside of the foot and at the opening that encircles the ankle (using the low rise style of shoe as an example in this case), and the zipper tab is pulled towards the front of the shoe, around the front of the shoe, and toward and alongside the outside of the foot. This is of course just one embodiment, and the zipper and zipper tab can be conveniently located on any part of the shoe so as to give effect to the purpose of the present invention, namely, to move at least a part of the top of the shoe away from the base or sole to provide easy access to the space when inserting the foot into the shoe. As long as the front of the shoe is opened up for heel entry, as will be described further below, the precise positioning of the zipper or other mechanism to effect opening and closing may vary according to the design of the shoe, and the preference of wearers who may have different needs and requirements. Regardless of the shoe style, the opening mechanism may be pulled down and towards the front and then across the entire front of the shoe thus allowing the entire front and top of the shoe to open away much like a flap.

This configuration or platform can be utilized for any and all shoe styles, from sneakers to boots to heels to dress shoes. While most of the accompanying drawings show for the most part a zipper configuration, it is not the only configuration that is available or may be used. For example, and as will be described, FIG. 6 demonstrates a zipper to open the front and side of a boot, and Velcro fastening up the side of the boot to open that portion. Snaps, velcro, hooks, zippers, as well as other fastening materials as well as a combination of any can be utilized based on design requirements.

When a person has a disability, either from birth or by accident at some point in life, their needs tend to be viewed through a medical filter only. For example, a person who may have suddenly lost muscular control of his lower extremities would continue to desire normal and conventional comforts, as well as clothing and shoes which may be fashionable and stylish. These needs would not diminish, but often the emphasis is on treatment and rehabilitation while normal creature comforts and preferences may sometimes be overlooked. Those in wheelchairs with limited or no muscular control of their lower extremities still have a need for well-designed and comfortable shoes, and the present invention can be used in a wide range of shoe types and designs, providing practical comfort and access without sacrificing fashion and style, and without the shoe being clearly identifiable as some type of medical device. Therefore, a shoe constructed in accordance with the present invention allows the world of fashion and style to once again be opened up to persons who are disabled or those who are born with such disabilities.

The present invention therefore provides for a shoe which is both a medical device as well as an item of fashion, all in the same product. With this marriage of form following function pre-emptive accommodations in sizing for swelling and incorrect extremity positioning may no longer be required.

In another arena completely, it appears that parents of small children can struggle significantly with putting shoes on little feet, specifically getting little toes to be pointed straight so the shoe can be put on correctly, and the foot and toes will be in a natural and unstressed position when inside the shoe. The utility of this shoe can also be used to accommodate this struggle by removing the need for co-operation with a 2 year old.

DETAILED DESCRIPTION OF THE INVENTION

Reference is now made to the accompanying drawings which illustrate a shoe in accordance with the present invention in various designs and styles. Note that the drawings herein show the potential range and application of a shoe of the present invention, and the invention is not to be considered in any way limited or restricted to the specific embodiments illustrated herein.

Figure 1:
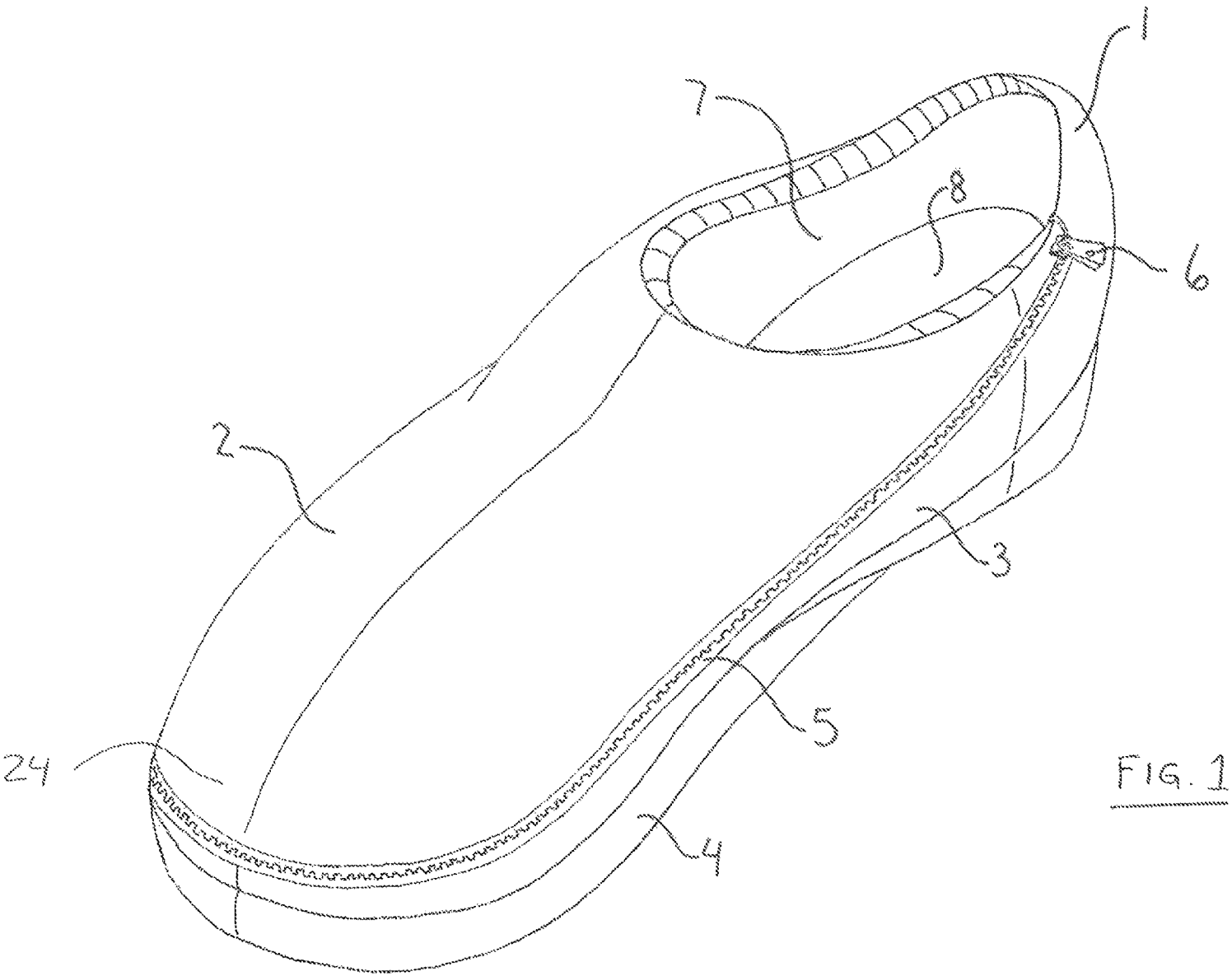
FIG. 1 is a top perspective view of a shoe in the closed position in one embodiment of the invention.

Reference is now made to FIG. 1 of the drawings which shows a shoe 1 in accordance with one aspect of the invention. The shoe 1 in this drawing is one of generally conventional style and size, but is adapted and configured to open and close in a unique way to facilitate easier insertion and removal of the foot from the shoe 1. The shoe 1 comprises a top flap 2 which is mounted on a sole 4 which forms the base of the shoe 1 upon which the foot will rest when inserted in the shoe 1. The top flap 2 comprises a side and bottom 3 which is fastened to the sole 4. The shoe 1 further comprises an ankle opening 7 and an interior 8 or space for accommodating the foot.

Figure 2:
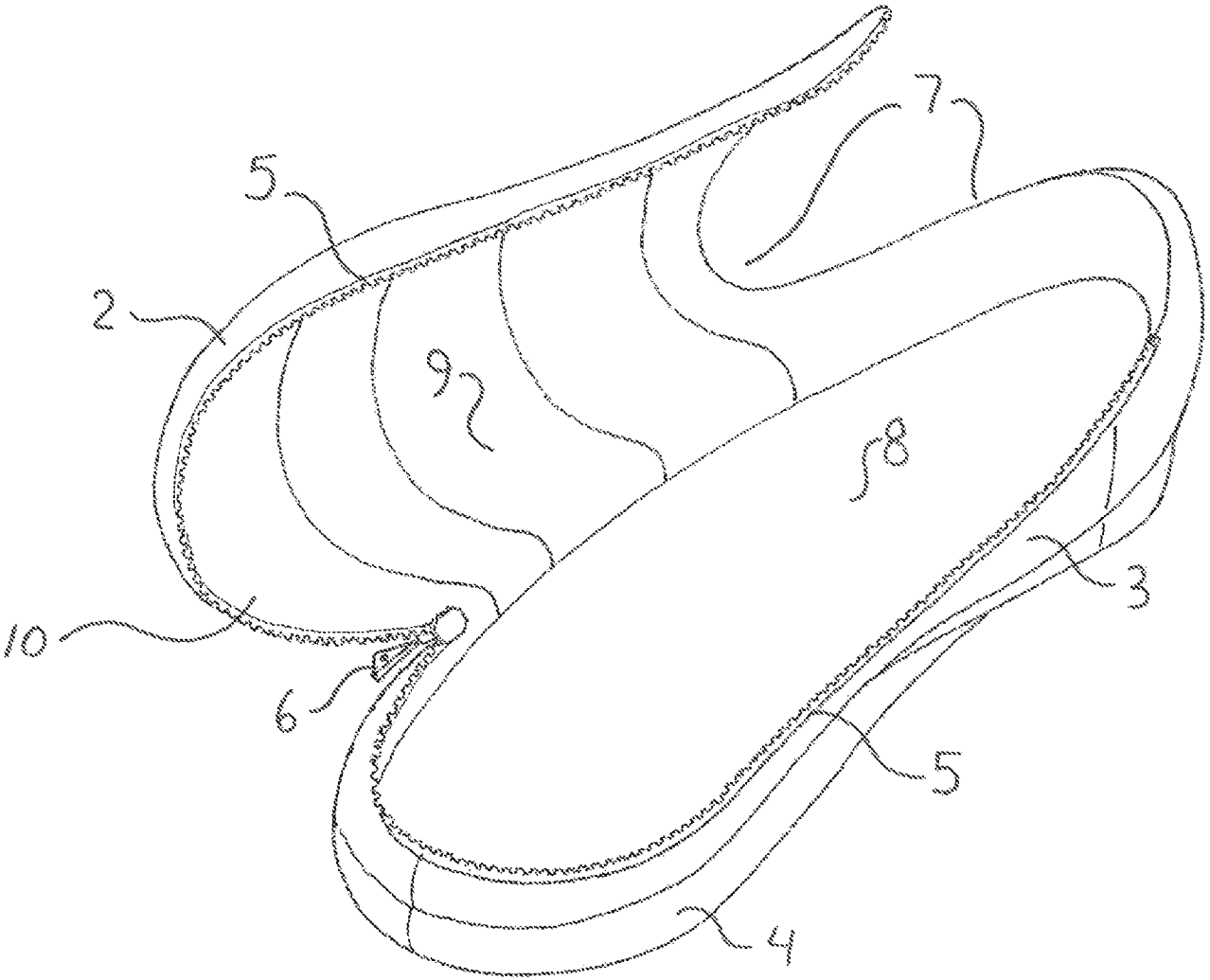
FIG. 2 is a top perspective view of the shoe illustrated in FIG. 1 of the drawings, in the open position.

A zipper 5 is formed within the top flap 2, and extends from the rim which forms part of the ankle opening 7. As seen in FIGS. 1 and 2 of the drawings, the zipper 5 extends from a starting point at the rim of the ankle opening 7, continues gradually downwardly along the inside edge of the top flap 2, and curves around the front 24 of the shoe 1. As best seen in FIG. 2 of the drawings, the zipper 5 thereafter extends a short way around the outer side of the shoe 1.

The opening and closing of the zipper 5 has the effect of opening the shoe 1 and providing access to the interior 8 of the shoe 1 in a manner which substantially facilitates putting on the shoe particularly, but also helps to remove the foot from the shoe more easily. In effect, and as is clearly illustrated in FIG. 2 of the drawings, the top flap 2 can be bent away from the sole 4 providing almost unfettered access to the upper part of the sole 4. FIG. 1 shows the shoe 1 in the closed position in which the zipper 5 is closed, while FIG. 2 of the drawings shows the shoe 1 in the open or accessible position in which the zipper 5 has been completely unzipped to provide the simple and advantageous access as described, and enabling the foot to be placed within the shoe without having to the pushed through the ankle opening 7. As will be described with reference to other figures herebelow, forcing the foot into the shoe through the ankle opening 7 may twist or scrunch the toes, especially for a person with disabilities or young children having less control over foot muscles, inhibiting circulation and causing possible swelling and discomfort.

FIG. 2 of the drawings shows that the top flap 2 can be opened or moved away from the upper part of the sole 4 by any desired amount, revealing and exposing the underside 9 of the top flap 2. In this position, the shoe 1 is also in a much better position to facilitate airing and cleaning, as may be desired by the user.

The embodiment illustrated in FIGS. 1 and 2 show a shoe 1 which does not have laces or a tongue. In this embodiment, the opening 7 is provided for the ankle and the upper part of the sole 4 receives the foot. The zipper is exposed, and easily operated by a zipper tab 6 to open and close the shoe 1. While the zipper 5 is exposed in this embodiment, it tends to run for the most part along the inside of the shoe, so that it is not as visible or obvious as it would be if it ran around the outside of the shoe. However, it is certainly within the scope of the present invention that the zipper 5 may be positioned in any convenient location on the shoe so as to give effect to the objective of the invention, namely, to provide a shoe where the top flap 2 can be moved relative to the sole 4 to provide the additional access, as described.

In the illustration shown in FIG. 2 of the drawings, a user would typically insert the foot in the shoe by first placing the heel of the foot near the open front end, and either sliding the foot backward over the upper surface of the sole 4, or sliding the shoe itself under the foot so that the heel of the foot moves over the upper surface of the sole 4 until it reaches the back of the shoe. With the foot properly and easily located in this way, the zipper 5 can be closed to fasten the top flap 2 to the sole 4 as illustrated in FIG. 1, with the foot comfortably and naturally positioned within the shoe without distorting the foot.

Figure 3:
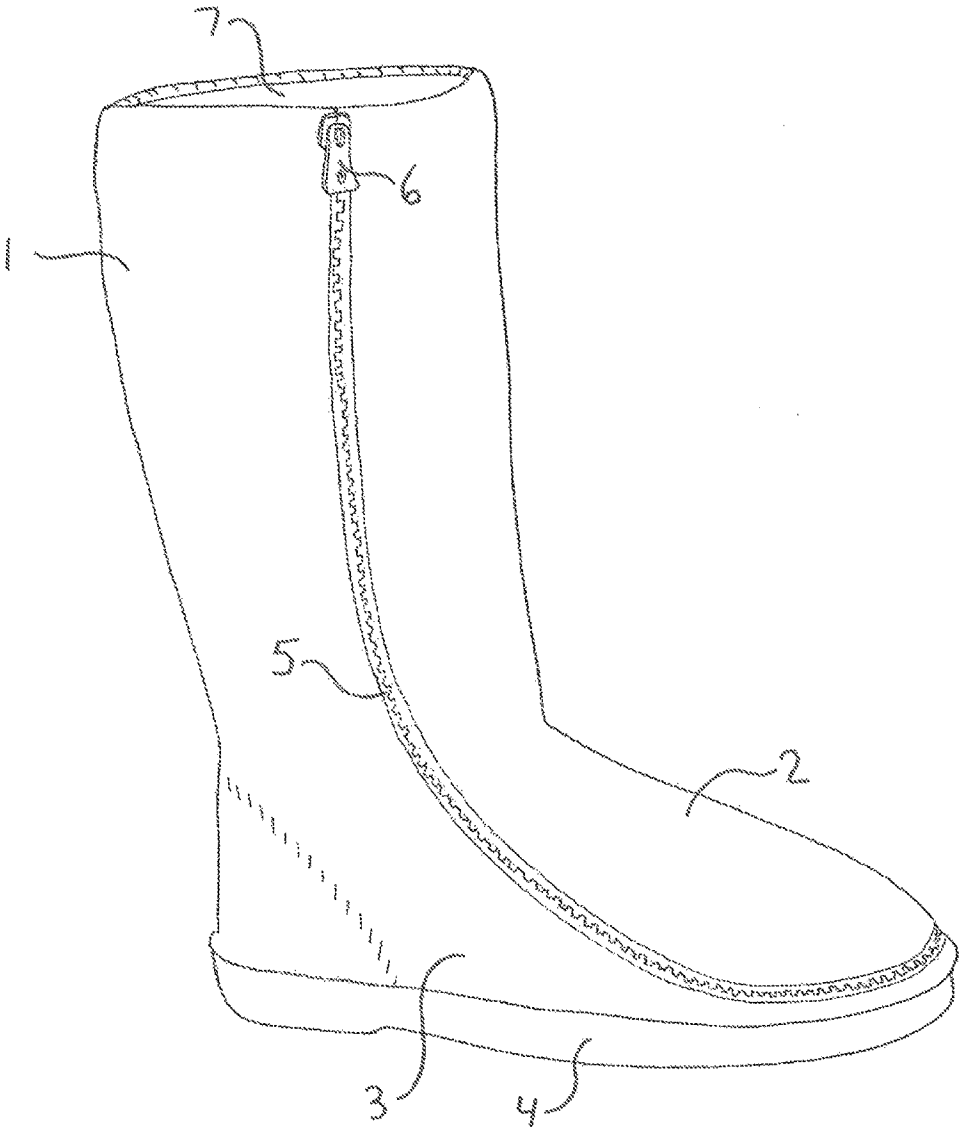
FIG. 3 is a side perspective view of a tall boot style shoe, in the closed position, in accordance with a further aspect of the invention.

Reference is now made to FIG. 3 of the drawings which shows the invention configured on a tall style boot, whereby the shoe can be adjusted between a closed position with the look of a normal conventional boot and an open position in which the top flap can be moved away to provide a much more substantial opening for improved access to the shoe. In FIG. 3, the boot 1 has a sole 4 upon which is mounted a top flap 2 which includes the side and bottom portion 3. The zipper 5 extends from the opening 7 all the way down the length of the boot, along the inside thereof and around the front of the boot 1, and thereafter a short distance around the other side of the boot 1, in a similar manner to that illustrated in FIG. 2 of the drawings.

The boot in FIG. 3 of the drawings is shown only in the closed position (as are the other embodiments and examples described below in FIGS. 4 to 6 of the drawings). However, the principle and mechanism for zipping and unzipping the zipper 5 to close and open the shoe respectively is the same as that illustrated above, to thereby provide ready access so that the foot can be inserted in the boot 1 in its natural an extended position, and held in the boot in that way once the zipper 5 has been closed.

Figure 4:
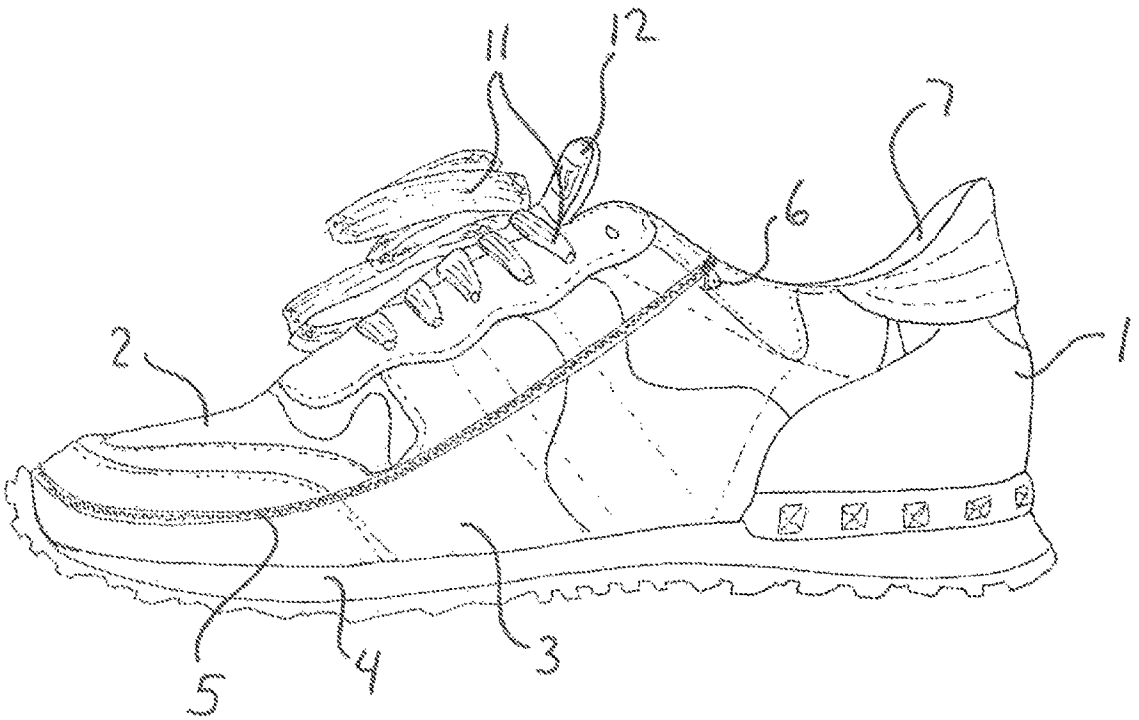
FIG. 4 is a side perspective view of a sneaker style shoe, in the closed position, illustrating a tongue and laces to maintain a visually "normal" shoe, in accordance with a further aspect of the invention.

FIG. 4 of the drawings shows a sneaker style of shoe 1 which retains its laces 11 and tongue 12. However, in this embodiment, the laces 11 and tongue 12 are more for cosmetic and design purposes and would not have any function in terms of putting on and removing the shoe 1. In this embodiment, the entire combination of laces 11 and shoe tongue 12 are permanently sewn into place, which allows the sneaker to maintain its aesthetic looks, and present the normal look of a sneaker. However, the sneaker 1 has, as illustrated, a zipper 5 which extends from the opening 7 down the side of the sneaker 1, around the front, and a short distance along the other side, as previously described, so that the top flap 2, which in this case includes the shoelaces 11 and shoe tongue 12, can be moved away when the zipper 5 has been unzipped. Ample access is thus provided so that the heel of foot can be moved from the front of the shoe towards the rear thereof, or, alternatively, the shoe can be pushed under the foot so the foot slides into the shoe. In yet another possibility, such as for those with some or limited muscular control over their toes and feet, the opening of the top flap 2 provides sufficient access so that the foot can simply be generally dropped in position on the sole 4, adjusted to ensure proper location, and the zipper 5 closed so as to capture the foot within the sneaker 1.

In FIG. 4, it is also shown that the zipper can be smaller in size when needed. As already mentioned, the starting point for the zipper 5 at the opening 7 can be at any convenient location at the opening 7 and need not be at the precise points or locations as illustrated in any of the drawings.

Figure 5:
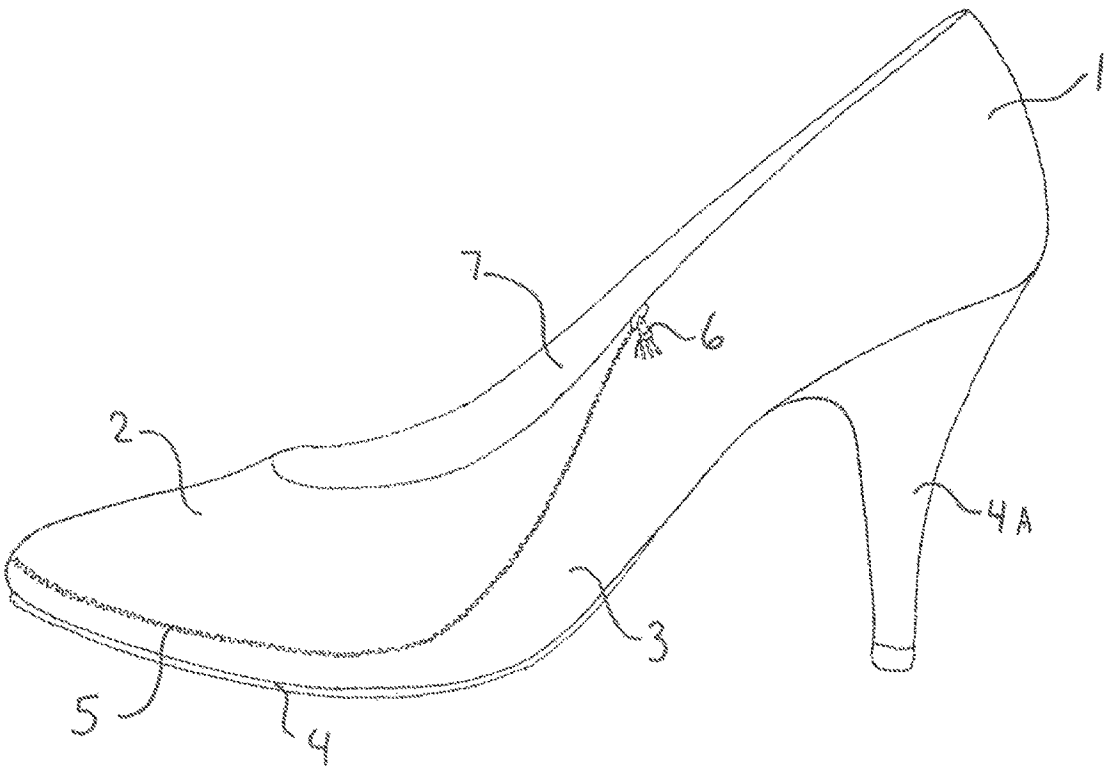
FIG. 5 is a side perspective view of a high heel style shoe, in the closed position, in accordance with a further aspect of the invention.

FIG. 5 of the drawings shows a high heel type shoe with a "princess" style zipper 5. This shoe 1 includes a high heel 4*a*, and a generally larger opening 7, as is conventional for a woman's high heel shoe. In the embodiment illustrated in FIG. 5, the zipper 5 has its starting point about midway along the opening 7, and extends downwardly along the side of the shoe, and around the front thereof, as described. In the shoe 1 illustrated in this figure, material may be provided which actually covers the zipper making it more difficult to perceive with a casual glance. The material covering the zipper may actually be configured as part of the style and fashion of the shoe so as to make it even less obvious that the shoe has any special structure which facilitates easier and better access. Further, the zipper tab 6 can be of a decorative nature in an effort to further detract from its more utilitarian function.

Figure 6:
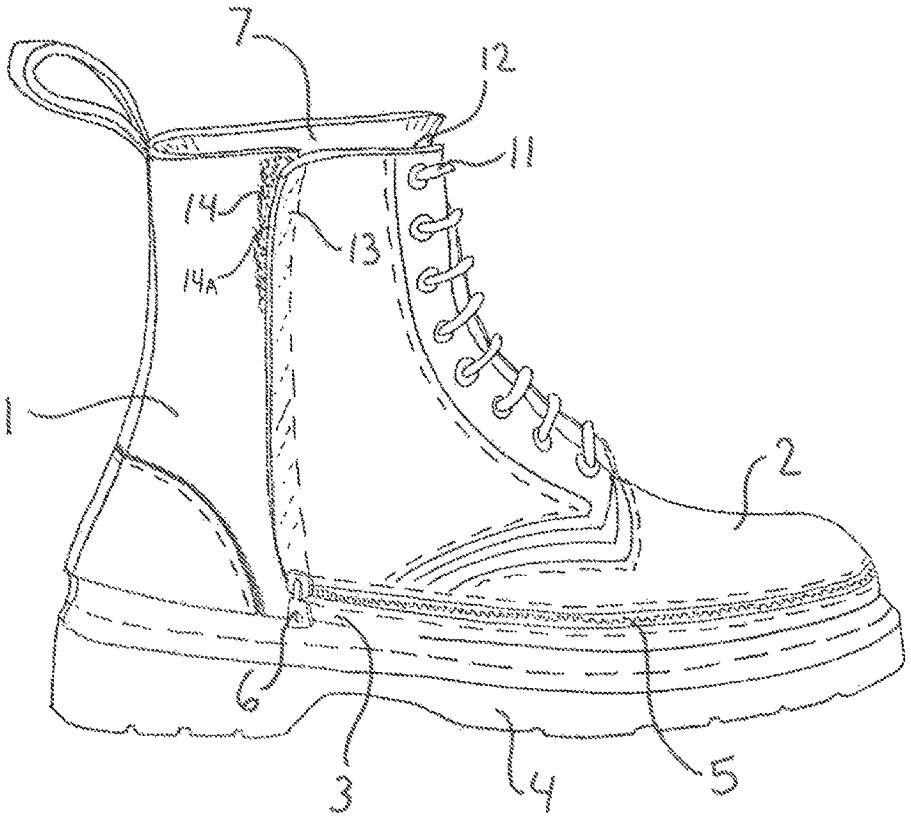
FIG. 6 is a side perspective view of a short boot style shoe, in the closed position, utilizing multiple fastener types for opening and closing the shoe in accordance with a further aspect of the invention.

FIG. 6 of the drawings shows a biker style short boot shoe type 1. The boot 1 has a sole 4, a top flap 2, laces 11 and a tongue 12. While the laces 11 may be decorative and nonfunctional, they may also be functional in another embodiment, so that they can be loosened or tightened by the wearer to accommodate a foot and ankle of different sizes. In the latter case, the user would tend to set the laces only occasionally, and set the size of the space.

In the embodiment illustrated in FIG. 6 of the drawings, a zipper 5 extends around the base of the top flap 2, along the inside of the shoe, around the front thereof, and continuing a short distance around the other side of the shoe. Further, there is provided a Velcro fastening, comprising a female strip 14 and a male strip 14*a*, the Velcro fastening extending from the opening 7 down the side of the boot 1 to the point where the zipper 5 starts. In this embodiment, opening the shoe to provide access as described above requires grasping the zipper tab 6 so as to open the zipper 5 around the shoe, and then separating the Velcro fastening by pulling apart the female strip 14 and male strip 14*a*. Once these two operations have been executed, the top flap 2 can be easily moved over so as to provide the access opening to the shoe for easy and convenient insertion of the foot in a manner which ensures that the foot and ankle are in as natural a position as possible.

FIGS. 7A, 7B, 7C and 7D of the drawings show a cross-section through a conventional shoe, and illustrates some of the difficulties that may result when a person who may be disabled or paralyzed tries to push the foot into the shoe through the opening. FIG. 7A shows a foot having a heel 20, arch 22, top 18, ankle bone 21, big toe 15 and toenail 17. The big toe 15 has a top side of the first joint 16 and a bottom of the first joint 19. The initial placement of the foot in the shoe through the opening continues normally until the opening of the shoe constrains the top of the foot 18 and the heel 20, which is located over the back of the shoe. By further forcing the foot into the shoe, as illustrated in FIG. 7B, the big toe 15 and other toes do not move easily, and the top of the foot 18 curves around. As seen in FIG. 7C, further forcing of the foot into the shoe causes the big toe to become bent or curled into an unnatural position, and FIG. 7D shows the foot inserted in the shoe with the toe hooked in an unnatural and uncomfortable position. Disabled or paralyzed persons would not have the ability to feel that the foot has been incorrectly placed in the shoe, but there may nevertheless be associated discomfort, swelling, as well as a reduction in circulation which may cause pain and even bruising.

Figure 7:
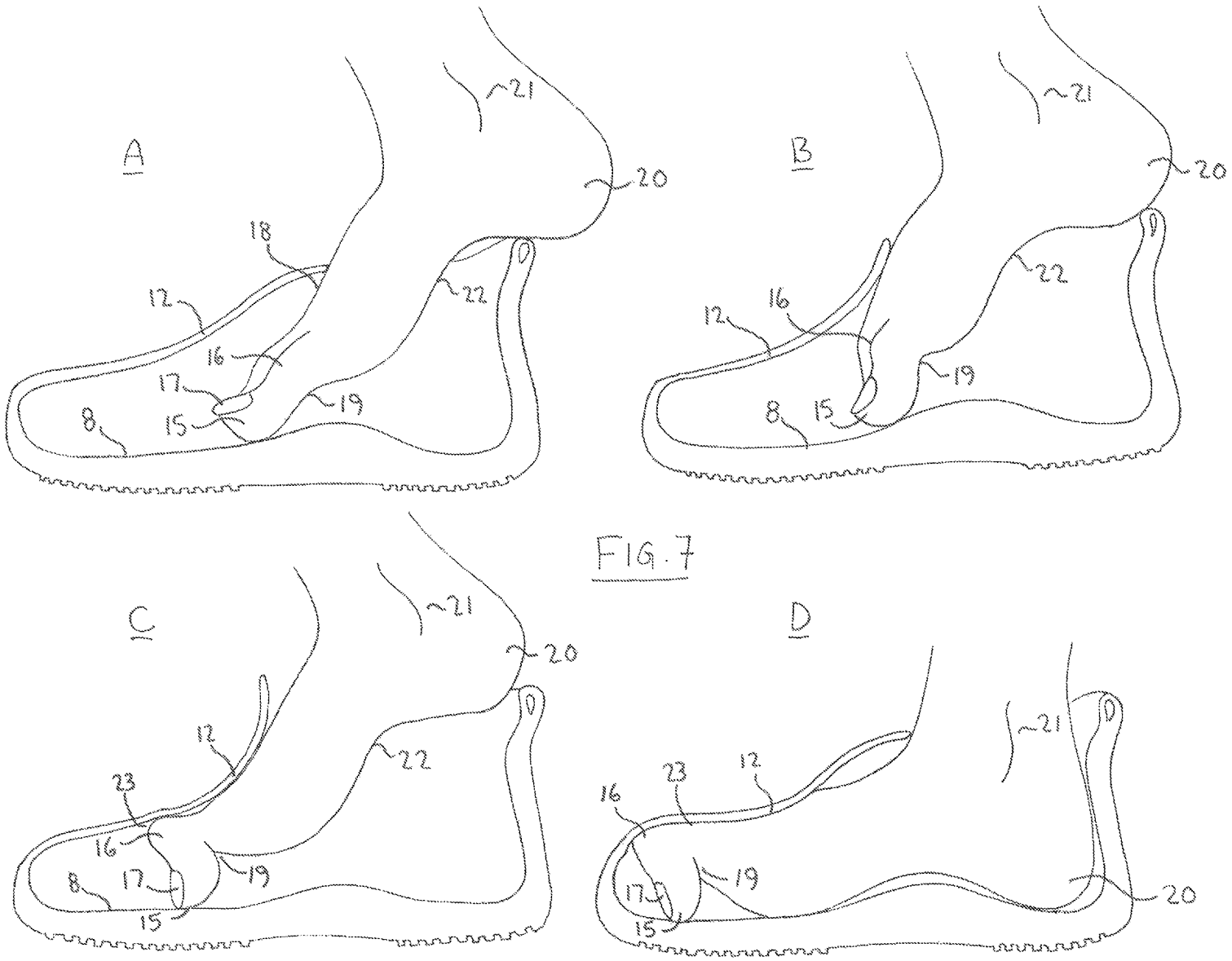
FIGS. 7A, 7B, 7C and 7D are section views through a shoe of conventional style illustrating in series the insertion of a foot which may have limited or no muscular control into the shoe.

FIG. 7 therefore illustrates the situation where a foot having no muscular control is being pushed into a normal shoe, and the subsequent effect on the toes, the arch, and the top of the foot. The foot becomes cramped and distorted within the shoe, and the toenail may be loosened or injured from rubbing the insole. The end of the toe can become calloused, and the big toe joints may rub up against the shoe due to the absence of space. The joint in the big toe as well as all of the other toes are bent, impeding proper blood flow which may cause the swelling as mentioned above, leading to deterioration of the toe and foot tissue.

FIGS. 8A, 8B, 8C and 8D of the drawings illustrates the situation where a foot having no muscular control may be more easily and comfortably inserted in a shoe constructed in accordance with the present invention. In FIG. 8A, with the top flap 2 in the open or unzipped position, the heel 20 of the foot is placed on the interior bottom of the shoe 8 at the front end thereof, and to which there is easy access. The shoe can then be moved forward in the direction of the arrow on the shoe, and/or the foot moved rearwardly in the direction of the arrow illustrated on the foot. FIG. 8B shows an intermediate position with the heel 20 of the foot moving rearwardly towards the back of the shoe, while FIG. 8C shows the foot in the near completed position and the toes in their natural state moving easily onto the interior bottom of the shoe. Finally, in FIG. 8D, the shoe is comfortably positioned around the foot, with the ankle, arch and toes in a natural comfortable position, and the top flap 2 is closed by closing the zipper 5 to capture and hold the foot snugly within the shoe. With the shoe of the invention, being put on the foot in the manner sequentially illustrated in FIGS. 8A, B, C and D of the drawings, there is little possibility of distortion, cramping or scrunching of the foot and toes. The health of the foot would therefore be preserved, and proper blood circulation can be achieved, while any swelling of the foot can be readily avoided or reduced.

Figure 8:
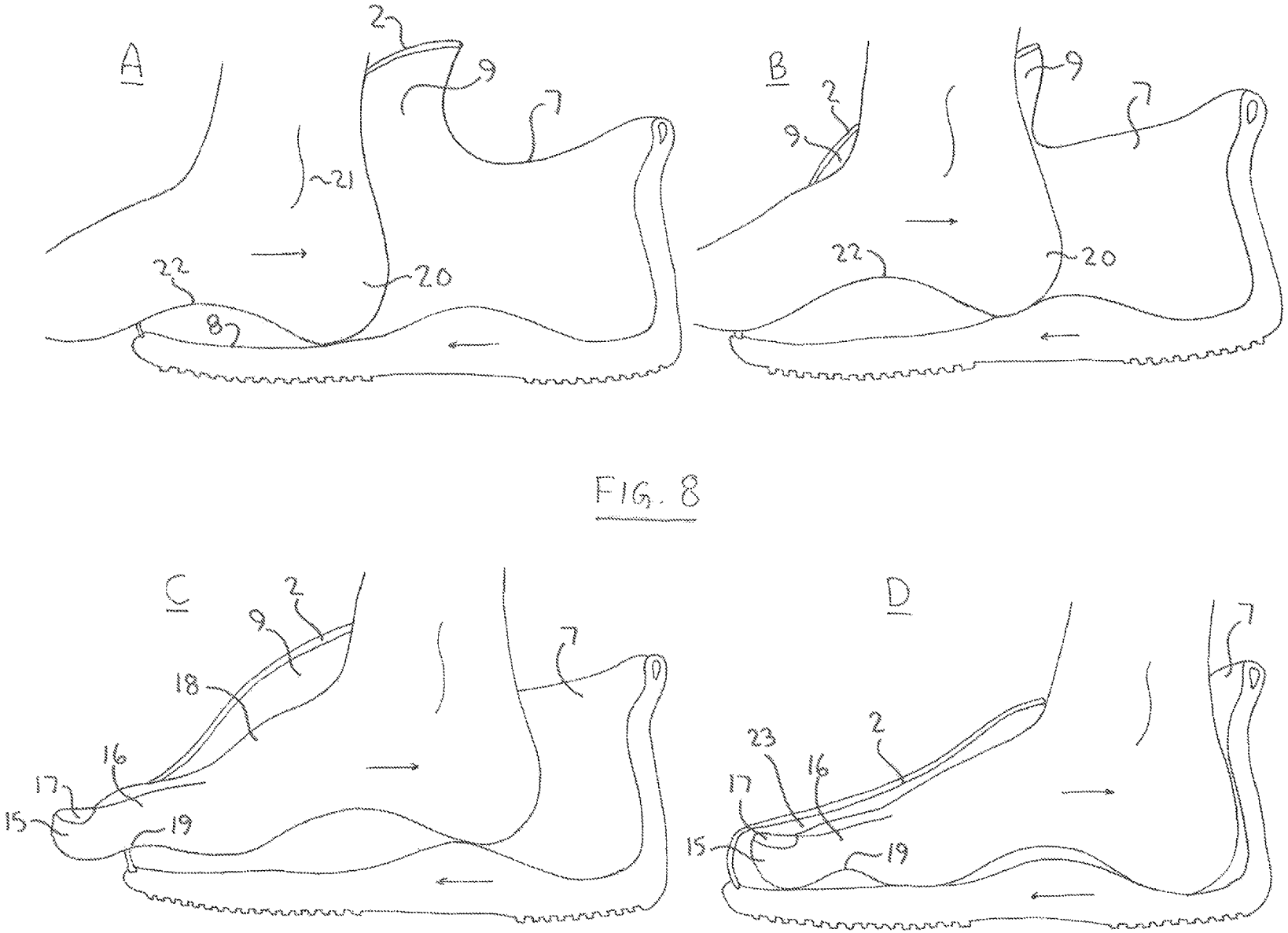
FIGS. 8A, 8B, 8C and 8D are section views through a shoe constructed in accordance with the present invention illustrating in series the insertion of a foot which may have limited or no muscular control into the shoe.

FIG. 8 therefore clearly illustrates the effectiveness and operation of the reverse entry shoe, allowing the toes to maintain the straight joints that are important for robust circulation and tissue health. The space 23 is maintained, unlike the situation as illustrated with respect to a conventional type shoe. When the toes are rolled under the foot, such as shown in FIG. 7D, the entire skeletal structure of the foot changes, the arch rises, and the top of the foot abuts against the top and tongue of the shoe causing an unnatural hump to the shape of the foot. This result can be readily and conveniently avoided entirely when a shoe constructed in accordance with the present invention is used.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A shoe comprising:

a sole having an upper surface with an outer edge and a lower surface;

a top member having a distal front end portion, a proximal heel end portion, a medial side and a lateral side and mounted on the sole, the top member and sole defining a space therebetween configured to receive a foot, the top member further having an ankle opening with a distal end and a proximal end and a lateral side and a medial side, a lower connective edge, a fold back portion, and a fixed portion;

a connection area for connecting the upper surface of the sole at the outer edge thereof and the lower connective edge of the top member, the connection area extending along the outer edge of the upper surface of the sole and the lower connective edge of the top member; and a single fastening means in the form of one continuous zipper fastener in the top member, the zipper fastener extending from a starting point at a midpoint between the distal end and the proximal end of the ankle opening on the lateral side of the ankle opening, traversing the lateral side of the top member at a descending angle directly towards the connection area where the lateral side of the top member becomes the distal front end portion continuing across the distal front end portion of the shoe at the connection area, to where the distal front end portion becomes the medial side of the top member and then traversing the medial side of the connection area, the zipper fastener travelling in a direction towards the proximal heel end portion of the shoe to a zipper termination point located midway between the distal front end portion of the shoe and the distal end of the ankle opening on the medial side of the top member such that the fold back portion of the top member is movable between a first position where the space is closed when the zipper fastener is closed to the ankle opening starting point and a second position where the space is open when the zipper fastener is unzipped to the zipper termination point thereby allowing the fold back portion of the top member to be folded back while the fixed portion of the top member is positioned to provide foot access to the space when the zipper fastener is open, the zipper fastener permitting a single and continuous motion to move completely from the ankle opening starting point to the zipper termination point to effect opening of the space and providing foot access to the space, and from the zipper termination point to the ankle opening starting point to effect closing of the space, respectively.

2. A shoe as claimed in claim 1 wherein the shoe comprises a sneaker shoe including laces and a tongue on the top member.

3. A shoe as claimed in claim 2 wherein the laces are adjusted to vary the size of the space according to the size of the foot accommodated therein.

4. A shoe as claimed in claim 1 wherein the top member is positioned to provide foot access over the distal front end portion to the space when the zipper fastener is open.

5. A shoe as claimed in claim 1 wherein the fixed portion comprises a part of the top member from the connection area at the upper surface of the sole extending from where the distal front end of the top member meets the lateral side of the top member and up to the zipper fastener, traversing the lateral side of the top member towards the proximal heel end portion, and once beyond the zipper fastener at the lateral side of the ankle opening the fixed portion increases in height to a dorsal portion of the lateral side of the ankle opening, across the proximal heel mend portion from the connection area to a dorsal plane of the ankle opening and continuing on the medial side where the fixed portion of the medial side mirrors that on the lateral side of the top member in relation to the ankle opening before reducing in height forward of the medial side of the ankle opening, the fixed portion then following a descending fold line comprising the distance between the connection area and the fold line beginning at a highest point where the medial side of the ankle opening and distal end of the ankle opening meet and traversing directly toward to the zipper termination point, the fixed portion offering lateral, medial, and proximal support to the foot once engaged in the shoe.

6. A shoe as claimed in claim 1 wherein the fold back portion comprises the top member across the entire distal portion of the ankle opening then following the zipper fastener on the lateral side from the ankle opening to where the lateral side becomes the distal front end portion, further comprising the width of the distal front end portion to where the distal front end portion meets the medial side and further to the zipper termination point and then following an ascending fold back line on the medial side from the zipper termination point to the distal medial corner of the ankle opening at a dorsal position, the fold back portion having four edges defined as the distal ankle opening edge moving towards the distal front end portion, the lateral side edge above the zipper fastener, the distal front end edge moving towards the ankle opening, and the medial side edge above the fold back line.

7. A shoe comprising:

a sole having an upper surface with an outer edge and a lower surface;

a top member having a distal front end portion, a proximal heel end portion, a medial side and a lateral side and mounted on the sole, the top member and sole defining a space therebetween configured to receive a foot, the top member further having an ankle opening with a distal end and a proximal end and a lateral side and a medial side, a lower connective edge, a fold back portion, and a fixed portion;

a connection area for connecting the upper surface of the sole at the outer edge thereof and the lower connective edge of the top member, the connection area extending along the outer edge of the upper surface of the sole and of the lower connective edge of the top member; and a single fastening means in the form of one continuous zipper fastener in the top member, the zipper fastener extending from a starting point at a midpoint between the distal end and the proximal end of the ankle opening on the lateral side of the ankle opening, traversing the lateral side of the top member at a descending angle directly towards the connection area where the lateral side of the top member becomes the distal front end portion of the shoe, defining a first wall in the top member between the connection area and the zipper fastener, the first wall being at its highest point, and farthest from the sole of the shoe at the zipper fastener starting point at the ankle opening on the lateral side of the top member and descending at a direct angle towards the connection area where the lateral side of the top member becomes the distal front end portion, the zipper fastener thereafter continuing across the distal front end portion of the shoe at the connection area, to where the distal front end portion becomes the medial side of the top member and then traversing the medial side of the top member at the connection area, the zipper fastener travelling in a direction towards the proximal heel end portion of the shoe to a zipper termination point located midway between the distal front end portion of the shoe and the distal end of the ankle opening on the medial side of the top member thus defining a second wall from directly behind the zipper termination point and traversing at an ascending angle directly towards a distal medial corner of the ankle opening at a most dorsal position, such that the top member between the first and second walls is movable between a first position where the space is closed when the zipper fastener is closed at the ankle opening starting point and a second position where the top member between the first and second walls is folded back to provide foot access to the space when the zipper fastener is open to the zipper termination point, the first wall on the lateral side of the top member and the second wall on the medial side of the top member forming guide barriers on each side of the space behind the distal front end portion, the zipper fastener permitting a single and continuous motion to move completely between the first position and the second position to effect closing and opening for foot access to the space respectively.

8. A shoe comprising:

a sole having an upper surface with an outer edge and a lower surface;

a top member having a front end portion, a rear heel end portion, an outer side and an inner side and mounted on the sole, the top member and sole defining a space therebetween configured to receive a foot, the top member further having an ankle opening with a front end and a rear end and an outer side and an inner side, a lower connective edge, a fold back portion, and a fixed portion;

a connection area for connecting the upper surface of the sole at the outer edge thereof and the lower connective edge of the top member, the connection area extending along the outer edge of the upper surface of the sole and the lower connective edge of the top member; and a single fastening means in the form of one continuous zipper fastener in the top member, the zipper fastener extending from a starting point at a midpoint between the front end and the rear end of the ankle opening on the outer side of the ankle opening, traversing the outer side of the top member at a descending angle directly towards the connection area where the outer side becomes the front end portion continuing across the front end portion of the shoe at the connection area, to where the front end portion becomes the inner side of the top member and then traversing the inner side of the connection area, the zipper fastener travelling in a direction towards the rear heel end portion of the shoe to a zipper termination point located midway between the front end portion of the shoe and the front end of the ankle opening on the inner side of the top member such that the fold back portion of the top member is movable between a first position where the space is closed when the zipper fastener is closed to the ankle opening starting point and a second position where the space is open when the zipper fastener is unzipped to the zipper termination point, thereby allowing the fold back portion of the top member to be folded back while the fixed portion of the top member is positioned to provide foot access to the space when the zipper fastener is open, the zipper fastener permitting a single and continuous motion to move completely from the ankle opening starting point to the zipper termination point to effect opening of the space and providing foot access to the space, and from the zipper termination point to the ankle opening starting point to effect closing of the space, respectively.

9. A shoe as claimed in claim 8 whereby the front end portion of the shoe serves as the entry location for the foot allowing a heel of a wearer to enter the front end portion of the shoe and slide back toward a heel area of the shoe.

10. A shoe as claimed in claim 8 wherein the top member is positioned to provide foot access over the front end portion to the space when the zipper fastener is open.

11. A shoe comprising:

a sole having an upper surface with an outer edge and a lower surface;

a top member having a front end portion, a rear heel end portion, an inner side and an outer side and mounted on the sole, the top member and sole defining a space therebetween configured to receive a foot, the top member further having an ankle opening with a front end and a rear end and an outer side and an inner side, a lower connective edge, a fold back portion, and a fixed portion;

a connection area for connecting the upper surface of the sole at the outer edge thereof and the lower connective edge of the top member, the connection area extending along the outer edge of the upper surface of the sole and of the lower connective edge of the top member; and a single fastening means in the form of one continuous zipper fastener in the top member, the zipper fastener extending from a starting point at a midpoint between the front end and the rear end of the ankle opening on the outer side of the ankle opening, traversing the outer side of the top member at a descending angle directly towards the connection area where the outer side becomes the front end portion of the shoe, defining a first wall in the top member between the connection area and the zipper fastener, the first wall having a highest point, and farthest from the sole of the shoe at the zipper fastener starting point at an outer side of the ankle opening and descending at a direct angle towards a lowest point closest to the connection area where the outer side becomes the front end portion, the zipper fastener thereafter continuing across the front end portion of the shoe at the connection area, to where the front end portion becomes the inner side of the top member and then traversing the inner side at the connection area, the zipper fastener travelling in a direction towards the rear heel end portion of the shoe to a zipper termination point located midway between the front end portion of the shoe and the front end of the ankle opening on the inner side of the top member thus defining a second wall from directly behind the zipper termination point and traversing at an ascending angle directly towards a front inner side corner of the ankle opening, such that the top member between the first and second walls is movable between a first position where the space is closed when the zipper fastener is closed at the ankle opening and a second position where the top member between the first and second walls is folded back to provide foot access to the space when the zipper fastener is open to the zipper termination point, the first wall on the outer side of the top member and the second wall on the inner side of the top member forming guide barriers on each side of the space behind the front end portion, the zipper fastener permitting a single and continuous motion to move completely between the first position and the second position to effect closing and opening for foot access to the space respectively.

12. A shoe as claimed in claim 8 wherein the fixed portion comprises a part of the top member from the connection area at the upper surface of the sole extending from where the front end of the top member meets the outer side of the top member and up to the zipper fastener, traversing the outer side of the top member towards the rear heel end portion and once beyond the zipper fastener at the ankle opening at the outer side of the ankle opening the fixed portion increases in height to reach the highest portion of the outer side of the ankle opening, across the rear heel end portion from the connection area to the highest plane of the ankle opening before continuing on the inner side where the fixed portion of the inner side mirrors that of the outer side in relation to the ankle opening before reducing in height once beyond the inner side of the ankle opening, the fixed portion comprising the distance between the connection area and a line beginning at a highest point where the inner side of the ankle opening and front end of the ankle opening meet and traversing directly toward to the zipper termination point, the fixed portion offering inner side, outer side, and rear heel end support to the foot once engaged in the shoe.

13. A shoe as claimed in claim 8 wherein the fold back portion comprises the top member across an entire front portion of the ankle opening then following the zipper fastener along the outer side to where the outer side becomes the front end portion, further comprising the width of the front end portion to where the front end portion meets the inner side and further to the zipper termination point and then following an ascending fold back line on the inner side from the zipper termination point to where the front edge of the ankle opening meets the inner side ankle opening at a highest position, the fold back portion having four edges defined as the front ankle opening edge moving towards the front end portion, the outer side edge above the zipper fastener, the front end edge moving towards the ankle opening, and the inner side edge above the fold back line.

14. A shoe comprising:

a sole having an upper surface with an outer edge and a lower surface;

a top member having a distal front end portion, a proximal heel end portion, a medial side and a lateral side and mounted on the sole, the top member and sole defining a space therebetween configured to receive a foot, the top member further having an ankle opening with a distal end and a proximal end and a lateral side and a medial side, a lower connective edge, a fold back portion, and a fixed portion;

a connection area for connecting the upper surface of the sole at the outer edge thereof and the lower connective edge of the top member, the connection area extending along the outer edge of the upper surface of the sole and the lower connective edge of the top member; and a single fastening means in the form of one continuous zipper fastener in the top member, the zipper fastener extending from a starting point at a midpoint between the distal end and the proximal end on the lateral side of the ankle opening, traversing the lateral side of the top member at a descending angle directly towards the connection area where the lateral side becomes the distal front end portion continuing across the distal front end portion of the shoe at the connection area, to where the distal front end portion becomes the medial side of the shoe and then traversing the medial side of the connection area, the zipper fastener travelling in a direction towards the proximal heel end portion of the shoe to a zipper termination point located midway between the distal front end portion of the shoe and the distal end of the ankle opening on the medial side of the top member;

the zipper fastener having an angle of descent that will vary according to the size of a shoe.

15. A shoe comprising:

a sole having an upper surface with an outer edge and a lower surface;

a top member having a distal front end portion, a proximal heel end portion, a medial side and a lateral side and mounted on the sole, the top member and sole defining a space therebetween configured to receive a foot, the top member further having an ankle opening with a distal end and a proximal end and a lateral side and a medial side, a lower connective edge, a fold back portion, and a fixed portion;

a connection area for connecting the upper surface of the sole at the outer edge thereof and the lower connective edge of the top member, the connection area extending along the outer edge of the upper surface of the sole and the lower connective edge of the top member;

a single fastening means in the form of one continuous zipper fastener in the top member, the zipper fastener extending from a starting point at a midpoint between the distal end and the proximal end on the lateral side of the ankle opening, traversing the lateral side of the top member at a descending angle directly towards the connection area where the lateral side becomes the distal front end portion the proximal heel end portion of the top member transitioning to the lateral side of the top member and forwardly to the zipper fastener starting point location, and transitioning to the medial side of the top member and forwardly to a fold over line that begins at the point the distal end of the ankle opening meets the medial side of the ankle opening at a most dorsal position, both medial and lateral sides maintaining a consistent height from the connection area to the dorsal plane of the ankle opening that encompasses and supports the proximal heel end portion from the midpoint of the ankle opening between the distal end and proximal end of the ankle opening on both the lateral side and the medial side of the top member.

16. A shoe comprising:

a sole having an upper surface with an outer edge and a lower surface;

a top member having a distal front end portion, a proximal heel end portion, a medial side and a lateral side and mounted on the sole, the top member and sole defining a space therebetween configured to receive a foot, the top member further having an ankle opening with a distal end and a proximal end and a lateral side and a medial side, a lower connective edge, a fold back portion, and a fixed portion;

a connection area for connecting the upper surface of the sole at the outer edge thereof and the lower connective edge of the top member, the connection area extending along the outer edge of the upper surface of the sole and the lower connective edge of the top member; and a single fastening means in the form of one continuous zipper fastener in the top member, the zipper fastener extending from a starting point on the lateral side of the ankle opening, traversing the lateral side of the top member at a descending angle directly towards the connection area where the lateral side of the top member becomes the distal front end portion, continuing across the distal front end portion of the shoe at the connection area, to where the distal front end portion becomes the medial side of the top member and then traversing the medial side of the connection area, the zipper fastener travelling in a direction towards the proximal heel end portion of the shoe to a zipper termination point located midway between the distal front end portion of the shoe and the distal end of the ankle opening on the medial side of the top member such that the fold back portion of the top member is movable between a first position where the space is closed when the zipper fastener is closed to the ankle opening starting point and a second position where the space is open when the zipper fastener is unzipped to the zipper termination point thereby allowing the fold back portion of the top member to be folded back while the fixed portion of the top member is positioned to provide foot access to the space when the zipper fastener is open, the zipper fastener permitting a single and continuous motion to move completely from the ankle opening starting point to the zipper termination point to effect opening of the space and providing foot access to the space, and from the zipper termination point to the ankle opening starting point to effect closing of the space, respectively.

17. A shoe as claimed in claim 16 comprising:

a sole having an upper surface with an outer edge and a lower surface;

a top member having a distal front end portion, a proximal heel end portion, a medial side and a lateral side and mounted on the sole, the top member and sole defining a space therebetween configured to receive a foot, the top member further having an ankle opening with a distal end and a proximal end and a lateral side and a medial side, a lower connective edge, a fold back portion, and a fixed portion;

a connection area for connecting the upper surface of the sole at the outer edge thereof and the lower connective edge of the top member, the connection area extending along the outer edge of the upper surface of the sole and the lower connective edge of the top member; and a single fastening means in the form of one continuous zipper fastener in the top member, the zipper fastener extending from a starting point on the medial side of the ankle opening, traversing the medial side of the top member at a descending angle directly towards the connection area where the medial side of the top member becomes the distal front end portion continuing across the distal front end portion of the shoe at the connection area, to where the distal front end portion becomes the lateral side of the top member and then traversing the lateral side of the connection area, the zipper fastener travelling in a direction towards the proximal heel end portion of the shoe to a zipper termination point located midway between the distal front end portion of the shoe and the distal end of the ankle opening on the lateral side of the top member such that the fold back portion of the top member is movable between a first position where the space is closed when the zipper fastener is closed to the ankle opening starting point and a second position where the space is open when the zipper fastener is unzipped to the zipper termination point thereby allowing the fold back portion of the top member to be folded back while the fixed portion of the top member is positioned to provide foot access to the space when the zipper fastener is open, the zipper fastener permitting a single and continuous motion to move completely from the ankle opening starting point to the zipper termination point to effect opening of the space and providing foot access to the space, and from the zipper termination point to the ankle opening starting point to effect closing of the space, respectively.

* * * * *